US005291859A

United States Patent [19]

Brinck et al.

[11] Patent Number: 5,291,859

[45] Date of Patent: Mar. 8, 1994

[54] CATALYTIC INCINERATION SYSTEM

[75] Inventors: Joseph A. Brinck, 5545 Annamarie Ct., Cincinnati, Ohio 45247; Stephen L. Reis, Cincinnati, Ohio

[73] Assignee: Joseph A. Brinck, Cincinnati, Ohio

[21] Appl. No.: 11,286

[22] Filed: Jan. 29, 1993

[51] Int. Cl.[5] ..... F22D 1/00

[52] U.S. Cl. ..... 122/7 R; 110/212; 110/345; 165/81; 422/173; 431/5

[58] Field of Search ..... 431/5; 422/173; 122/7 R; 165/81; 110/212, 214, 344, 345, 233, 234

[56] References Cited

U.S. PATENT DOCUMENTS 4,444,735 4/1984 Birmingham et al. ..... 431/5 X
4,983,364 1/1991 Buck et al. ..... 431/5 X
5,161,488 11/1992 Natter ..... 431/5 X

*Primary Examiner*—Edward G. Favors
*Attorney, Agent, or Firm*—Wood, Herron & Evans

[57] ABSTRACT

A catalytic incinerator system for oxidation/combustion of volatile organic compounds (VOCs). The system is relatively compact, is designed to accommodate the thermal stresses within the system without adversely affecting the system components, and to provide substantially uniform temperature distribution in the VOCs and combustion air. The system includes a dual shell housing having an inner shell and an outer shell, wherein the inner shell is capable of thermal expansion and movement relative to the outer shell. Also included is a multi-pass tube-type heat exchanger suspended or otherwise mounted within a heat exchange chamber. The heat exchanger is mounted within the heat exchange chamber so that one end is unfixed and thus the heat exchanger can freely expand and contract due to temperature fluctuations within the heat exchange chamber. Additionally, a unique baffle system is disposed in the flow path of the VOCs and combustion air within the combustion chamber to provide a uniform temperature distribution, resulting in substantially complete oxidation of the VOCs.

7 Claims, 4 Drawing Sheets

CATALYTIC INCINERATION SYSTEM

FIELD OF THE INVENTION

The present invention is directed to a system for disposing of harmful volatile organic compounds, and more particularly to a catalytic incinerator system.

BACKGROUND OF THE INVENTION

In a wide variety of industries, including processing and manufacturing facilities, exhaust gas streams containing harmful volatile organic compounds (VOC's) are generated. Representative industries include graphic arts; printing; textiles; metal coating, including can, coil and film coating; production of magnetic tape; metal finishing; all varieties of chemical and petrochemical processes; resin and plastics production, etc. Because strict compliance with EPA guidelines and other regulations on exhaust gas stream composition is paramount, it is necessary to adequately treat exhaust gas streams containing VOC's to reduce the presence of the VOC's to acceptable levels. Under appropriate conditions, typical VOC's generated in the industries identified above, and others, can be oxidized and converted to carbon dioxide ($CO_2$) and water vapor.

Systems which catalytically incinerate (oxidize) VOC's are known in the art. Stelter & Brinck, Inc. of Harrison, Ohio, is one designer and manufacturer of such systems. In a typical catalytic incineration system, the VOC's are supplied to the system and conveyed therethrough by means of a blower. Since catalytic oxidation of VOC's typically occurs only at elevated temperatures, on the order of 550° F. and higher, it is necessary to heat the VOC's. This is generally accomplished by means of a flame burner which heats the air stream containing the VOC's to a sufficiently elevated temperature for oxidation. The VOC's and combustion air are then contacted with a suitable catalyst which initiates the oxidation reaction; this reaction produces $CO_2$ and water vapor as exhaust. Since the oxidation reaction is exothermic (i.e., it generates heat), it has been recognized that the overall energy efficiency of the system can be improved by utilizing at least one heat exchanger to recover the latent heat from the hot exhaust vapors produced in the oxidation reaction and transferring that heat to the incoming VOC's, to preheat them.

One important consideration in the design of catalytic incinerators is obtaining temperature uniformity of the gases contacting the catalyst. Temperature uniformity is important to ensure substantially complete oxidation of the VOC's. Accomplishing this uniformity has proved to be a difficult task in the past. Additionally, known catalytic incinerators typically had to be fairly large to accommodate a heat exchanger that transfers heat to the VOC's with a reasonable degree of efficiency. Another drawback of known catalytic incinerators is their susceptibility to thermal stresses, particularly in the area of the heat exchanger.

As will be described hereinbelow, the present invention is believed to overcome the various drawbacks associated with known catalytic incinerators, while providing all the advantages and flexibility of such known systems.

SUMMARY OF THE INVENTION

Catalytic incineration systems of the present invention are intended to be at least of equal capacity to known incinerators, but are more compact, designed to accommodate the thermal stresses within the system without adversely affecting the system components, and provide substantially uniform temperature distribution in the VOC's and combustion air.

In its broadest aspects, the present invention is directed to a system for catalytically incinerating volatile organic compounds (VOC's or volatile organics) which comprises a dual shell housing having an outer shell and an inner shell. The inner shell is capable of thermal expansion and movement relative to the outer shell and defines a heat exchange chamber and a combustion chamber within the system. A blower is utilized for conveying the VOC's from an inlet source through the heat exchange chamber for pre-heating and then to the combustion chamber for oxidation/incineration.

A multi-pass, tube-type heat exchanger is suspended or otherwise mounted within the heat exchange chamber. The heat exchanger comprises a plurality of tubes through which the VOC's pass and a pair of tube sheets. The tubes are affixed, such as by welding, at their respective ends to the first and second tube sheets. The heat exchanger may be suspended from a flange within the heat exchange chamber so that at one end it is unfixed to the inner shell of the system. With this configuration, the heat exchanger can freely expand and contract due to the temperature fluctuations within the heat exchange chamber. This serves to reduce thermal stresses placed on the system housing and the heat exchanger itself, thereby increasing the longevity of the system and reducing required repairs.

The system further includes a high pressure blower which supplies combustion air to the combustion chamber for mixing with the pre-heated VOC's. The combustion air and VOC's are then heated by a flame-type burner to the required incineration temperature, which will vary depending on the composition of the VOC's, but is typically at least about 550° F. higher.

Since it is important to provide a uniform temperature distribution within the VOC's to achieve substantially complete oxidation thereof, a unique baffle system is disposed in the flow path of the VOC's and combustion air within the combustion chamber for this purpose.

Finally, the system includes a suitable catalyst through which the heated VOC's and combustion air pass. Since the temperature of the VOC's is already elevated to combustion temperature, contact with the catalyst initiates the oxidation reaction and substantially complete oxidation of the VOC's is accomplished. The oxidation of VOC's is an exothermic reaction and thus generates hot exhaust gases containing water vapor and carbon dioxide; these exhaust gases may be at temperatures in the range of greater than 700° to 1000° F. The hot exhaust gases then pass through the heat exchange chamber on the "shell" side of the heat exchanger tubes to transfer the waste heat of the gases to the VOC's passing through the tubes.

In a preferred embodiment, the tubes of the multipass heat exchanger hang substantially vertically within the heat exchange chamber and thus expand and contract in the vertical direction due to temperature therein. Either the upper or lower tube sheet, but not both, may be rigidly fixed within the heat exchange chamber and the other sheet is unfixed and free to "float" therein. This arrangement allows for a relatively compact configuration of the overall system and reduces the thermal stresses on the heat exchanger and on the housing for the system.

Furthermore, the system may preferably include a flex joint in the flow path of the VOC's which is downstream of the heat exchanger and upstream of the combustion chamber. A second flex joint may be used and located ahead of the heat exchanger, but downstream of the system blower. Such flexible joints accommodate expansion of the inner shell of the housing due to temperature variations and further reduces the thermal stresses in the system. Additionally, a perforated plate is preferably arranged across the flow path of the VOC's downstream of the heat exchanger and upstream of the burner. The perforated plate provides uniformity of flow of the VOC's across the burner, thereby reducing localized heating of the VOC's, which aids in achieving overall temperature uniformity prior to oxidation. If desired, an optional filter may be included in the system at any convenient location, one of which is downstream of the heat exchanger and upstream of the perforated plate. The purpose of this optional filter is to screen any particulate matter which may be carried by the VOC stream.

One final aspect of the system of the present invention is an access port in the housing which penetrates the outer shell and facilitates measuring one or more physical parameters (such as temperature or pressure) within the system.

These and other features and advantages of the system of the present invention will become apparent to persons skilled in the art upon review of the Figures in connection with the detailed description which follows.

DETAILED DESCRIPTION

Figure 1A:
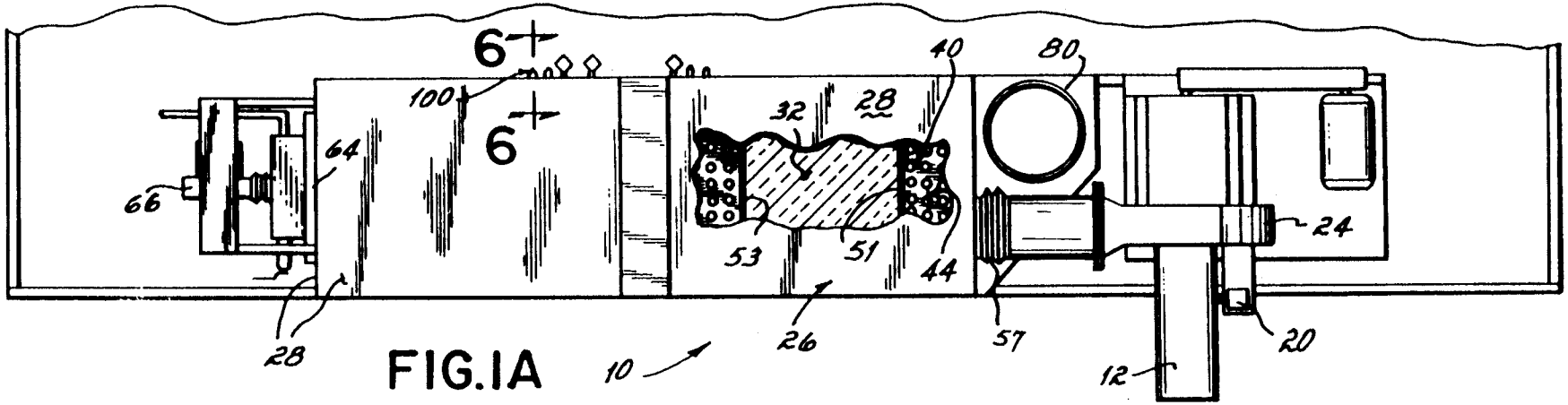
FIG. 1A is a top plan view, partially broken away, of the system shown in FIG. 1.
Figure 1:
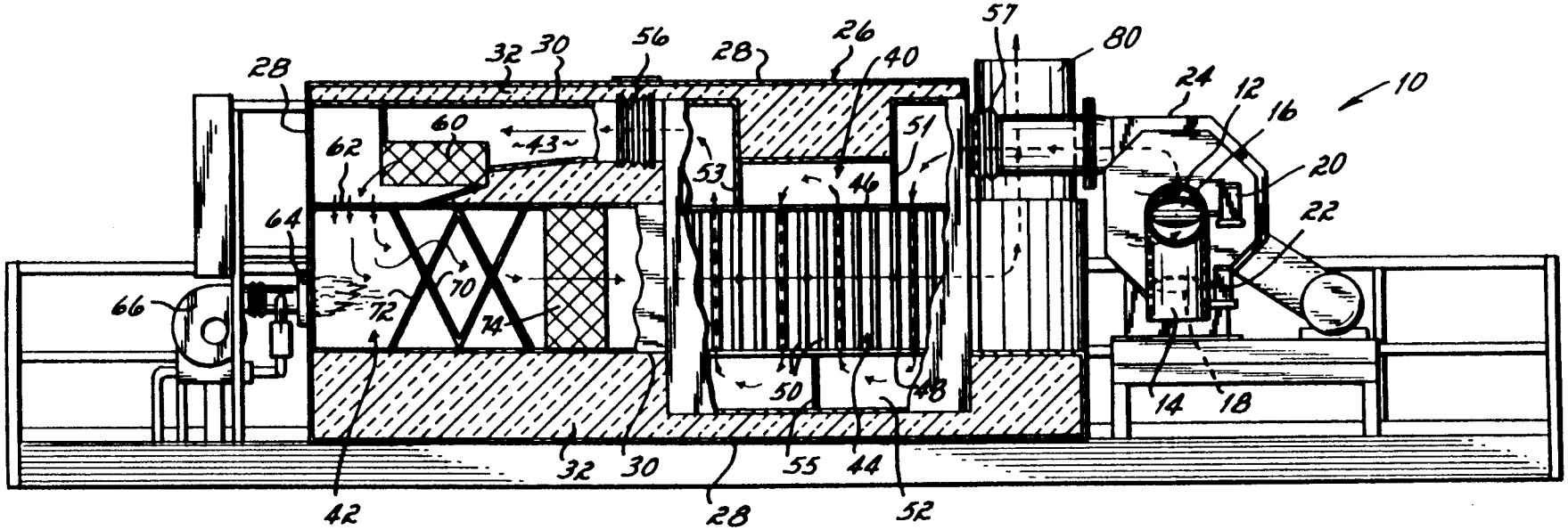
FIG. 1 is a side elevation, in partial cross-section and partially broken away, of the system of the present invention.

A preferred embodiment of a catalytic incineration system 10 of the present invention is shown in detail in FIGS. 1 and 1A. System 10 may be mounted on a rooftop, on the ground, or on a suitable support structure (not shown) such that the incineration system is reasonably closely adjacent the source of VOC's to be incinerated therein.

As shown, the system includes an inlet duct 12 for conveying the VOC's from their source to the incineration system. A duct 14 is also provided through which air is drawn into the system and used to purge the system prior to start-up. Ducts 12 and 14 each have a flapper valve 16, 18, respectively, therein which are controlled by modulating motors 20 and 22. During the purging operation, valve 16 in duct 12 is closed and valve 18 in duct 14 is open. When the system is operative to oxidize VOC's, valve 16 is open and valve 18 is closed. VOC's and purge air are drawn into and conveyed through the system by means of process blower 24. All of the above-described apparatus elements are preferably situated outside of the main housing 26 of system 10.

System housing 26 is a dual shell housing comprising an outer shell 28 and a inner shell 30. Inner shell 30 is preferably a fully sealed stainless steel shell with a layer of insulation 32 on its outer surface, as is shown more clearly in FIG. 6. In addition to the insulation layer 32, there may also be an air gap 34 between the insulation layer and the outer shell 28, which accommodates expansion and movement of the inner shell relative to the outer shell. Inner shell 30 of housing 26 defines a heat exchange chamber 40 and a combustion chamber 42. These chambers may have a transfer duct 43 connecting them to allow passage of the VOC's from heat exchange chamber 40 to combustion chamber 42.

Figure 2:
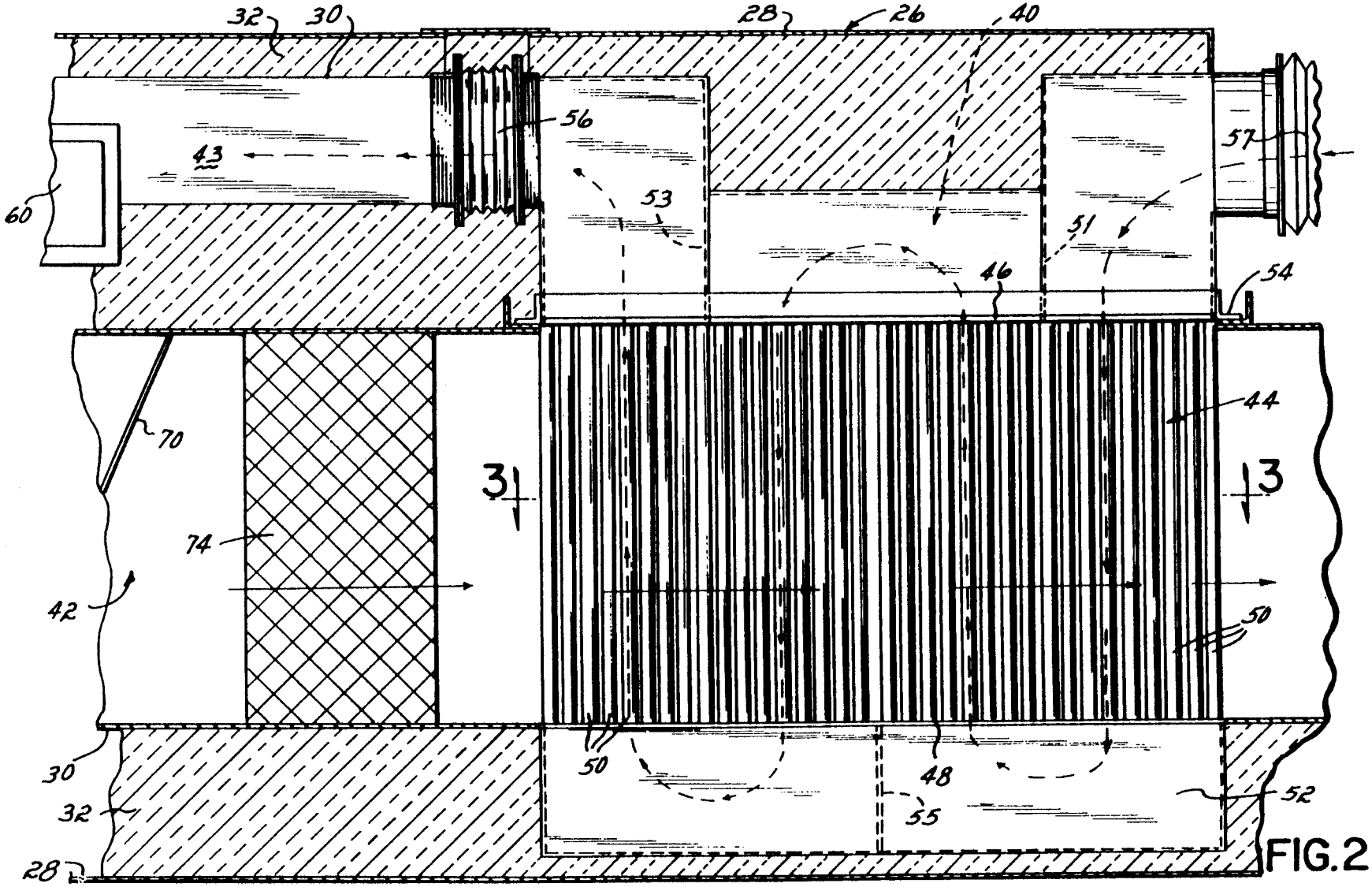
FIG. 2 is an enlarged cross-section of a portion of the system of FIG. 1.
Figure 3A:
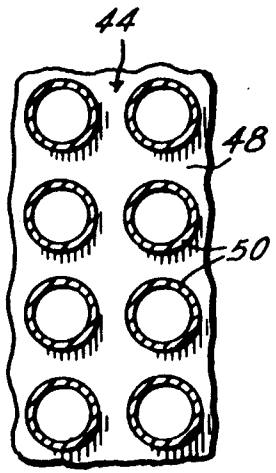
FIG. 3A is an enlarged view of that portion of FIG. 3 encompassed by line 3A—3A.
Figure 3:
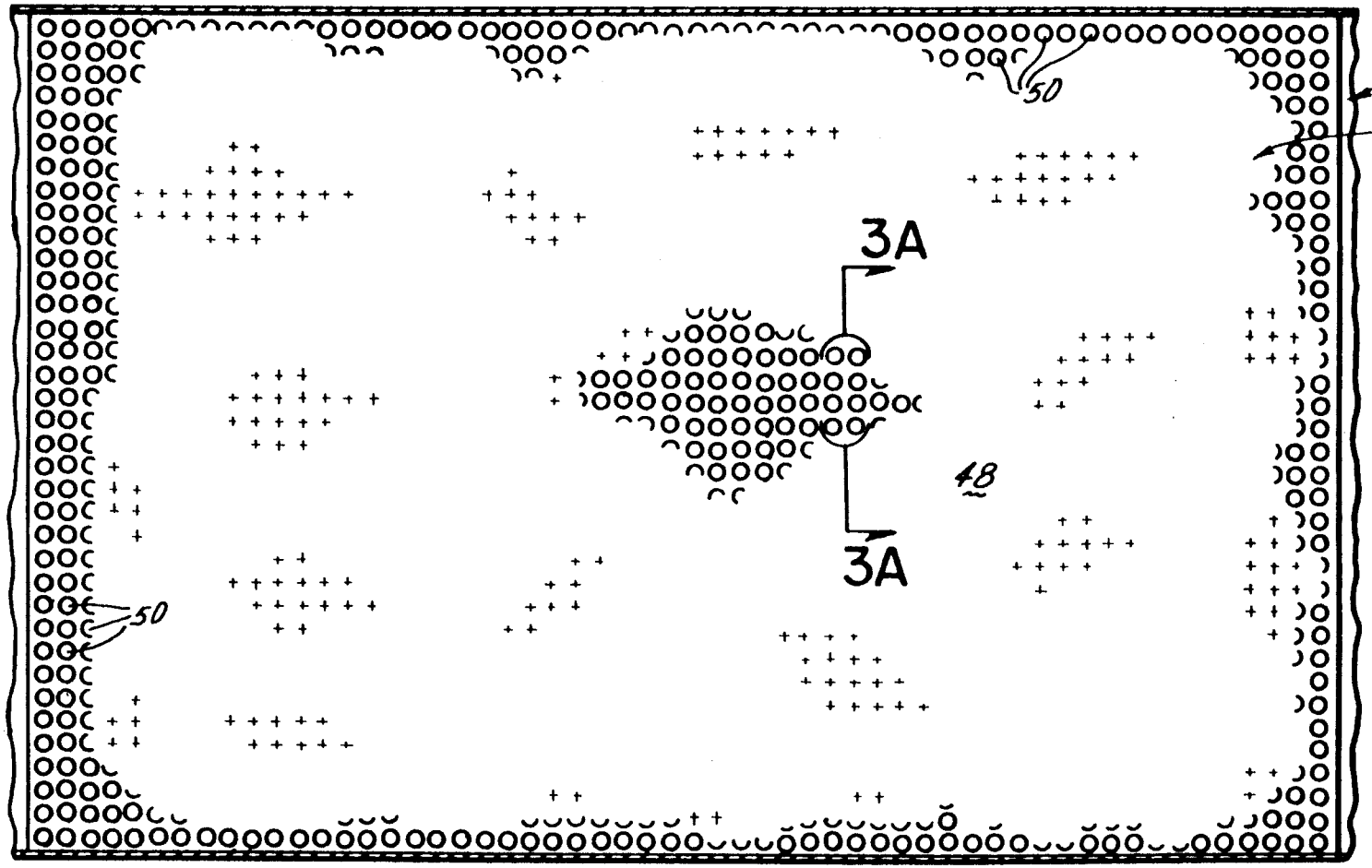
FIG. 3 is an enlarged cross-sectional view taken on line 3—3 of FIG. 2.

Heat exchange chamber 40 and the heat exchanger 44 mounted therein are shown in greater detail in FIG. 2. The dotted line arrows shown in FIG. 2 generally represent the flow direction and path of the VOC's, which are conveyed to the heat exchange chamber and through the system by system blower 24. With specific reference to FIGS. 2 and 3, heat exchanger 44 comprises an upper tube sheet 46, a lower tube sheet 48, and a plurality of vertically disposed heat exchange tubes 50 welded at their respective ends to upper and lower tube sheets. In a preferred embodiment, heat exchanger 44 comprises ¾" OD tubing on 1.25" centers. The heat exchanger shown is a 4-pass heat exchanger with baffles 51, 53 and 55 in the head space above and below the upper and lower tube sheets to direct the VOC's through tubes 50. It will be appreciated that a 2-pass heat exchanger can be utilized or any other suitable number of passes. It has been found that a 4-pass heat exchanger of the type shown provides significantly enhanced heat exchange efficiency vis-a-vis a 2-pass heat exchanger.

Heat exchange chamber 40 has a plenum space 52 in the region below the lower tube sheet 48. Additionally, a flange member 54 is welded or bolted to the perimeter of upper tube sheet 46 to suspend heat exchanger 44 in heat exchange chamber 40. Heat exchanger 44 is unfixed to inner shell 30 at its lower end and thus can freely expand in the vertical direction, particularly downwardly into plenum space 52. This arrangement virtually eliminates thermal stresses on heat exchanger 44 and on inner shell 30, which would be expected to occur if the heat exchanger was rigidly fixed thereto at both ends. It will be appreciated that heat exchanger 44 could be rigidly fixed at its lower end and free at its upper end so that it expands vertically and upwardly in response to temperature increases.

The system may preferably include a flex joint at either end of heat exchanger 44. The downstream flex joint 56 is located in the VOC transfer duct 43 and the upstream flex joint 57 is located between the blower 24 and the heat exchange chamber 40. The flex joints 56 and 57 are designed to accommodate thermal expansion of the system caused by the heated VOC's. These flex joints serve to further reduce thermal stresses in the system. Thereafter, the VOC's continue flowing through transfer duct 43 to combustion chamber 42. In one embodiment, an air filter 60 may be placed in the flow path of the VOC's in the transfer duct 43 for the purpose of removing particulate matter, etc. The filter 60 can be a bed of spent catalyst pellets, or a filter media similar to a home heater filter.

Figure 4:
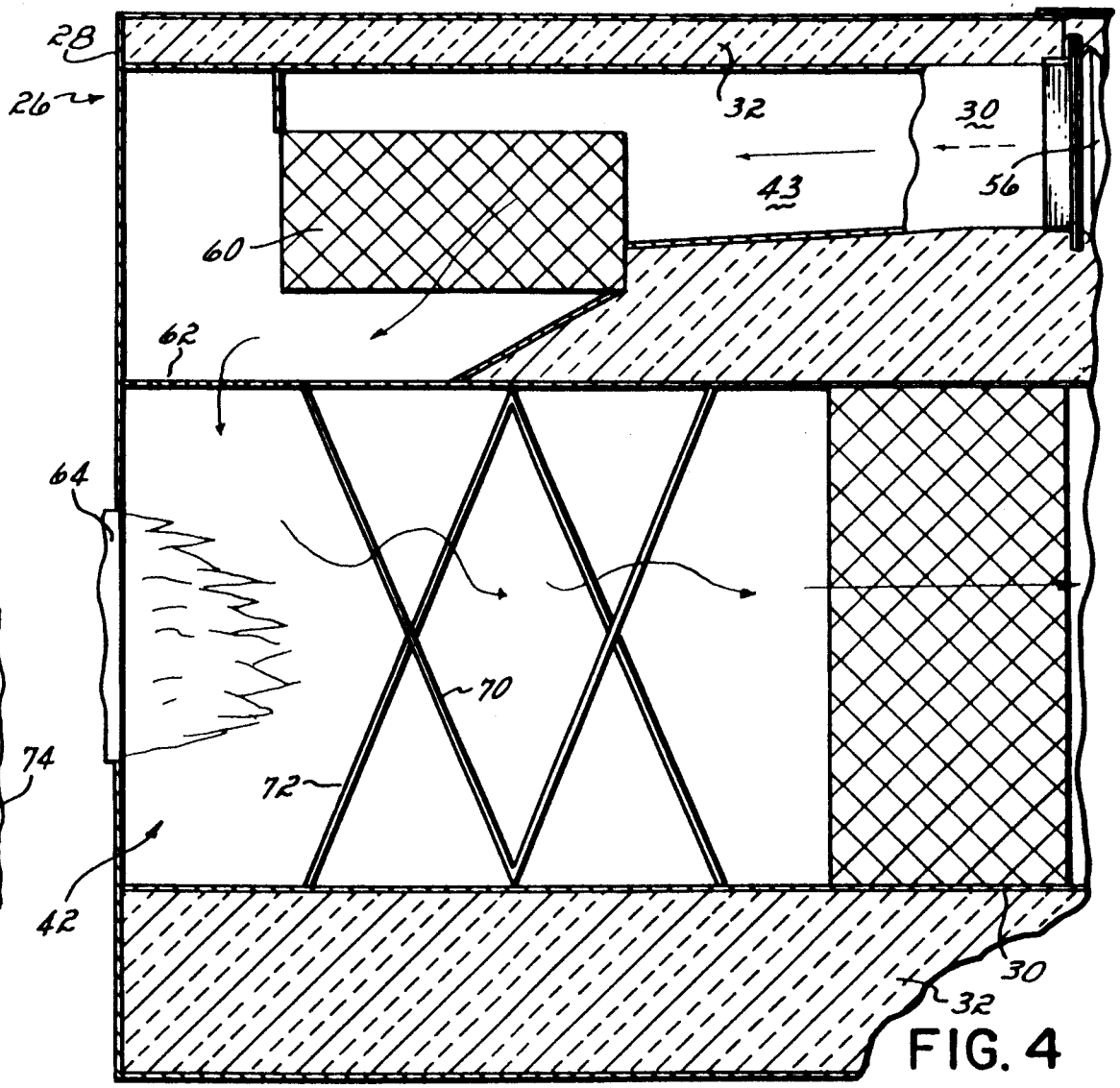
FIG. 4 is an enlarged cross-section of another portion of the system of FIG. 1.

With reference to FIG. 4, downstream of filter bed 60 a plate 62 is disposed in the flow path of the VOC's. This plate is perforated to allow VOC's to flow therethrough. The perforated plate is intended to provide uniform flow of the VOC's into the combustion chamber to prevent localized heating thereof. It is preferable that perforated plate 62 has enough open area so that a pressure drop across the plate on the order of at least about 0.5" of water results. After passing through perforated plate 62, the VOC's are heated in the combustion chamber by the flame of a line-type burner 64 which is mounted to the outer shell 28 of housing 26 and directs its flame inwardly as shown in FIGS. 1 and 4. The use of a line-type burner is preferred since it results in more uniform temperature distribution in the air and VOC's.

Combustion air is supplied to the combustion chamber by means of a high pressure blower 66. A relatively high pressure blower is preferred since it renders inconsequential any back pressure fluctuations which would cause the burner to go out if a lower pressure blower is used, without the need for any pressure control mechanism. Suitable blowers will have a pressure rating at approximately 1000% of the expected back pressure fluctuation. The combustion air supplied by blower 66 and the VOC's are mixed together and heated by the burner flame to a temperature sufficiently high to accomplish oxidation of the VOC's, which is generally at least about 550° F.

Figure 5:
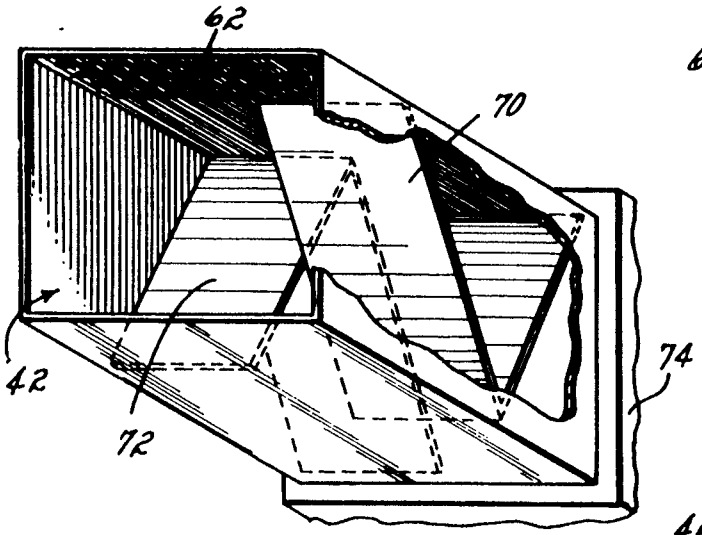
FIG. 5 is a perspective view of the baffles shown in FIG. 4.

As shown in FIG. 1, and in isolation in FIG. 5, combustion chamber 42 has at least one, and preferably two, flow baffles 70, 72 disposed therein. As shown, these baffles are V-shaped and are positioned laterally adjacent one another, with one in an inverted orientation relative to the other one. With this arrangement, a tortuous flow path is provided for the heated air and VOC's, which serves to create a substantially uniform temperature distribution in those gases. This is an important aspect of the system of the present invention, since uniform temperature distribution insures substantially complete oxidation of the VOC's. The flow baffles also serve to prevent direct exposure of the burner flame to temperature thermocouples (not shown) in the combustion chamber, which monitor the gas temperature therein. This will reduce the likelihood of inaccurate temperature measurements.

As represented by the arrows in FIG. 4, the combustion air and VOC's next pass through an oxidation catalyst 74. The oxidation catalyst 74 is preferably a monolith consisting of platinum washcoat on a stainless steel substrate which is perforated to insure even air flow therethrough. It will be appreciated that any other known oxidation catalyst suitable for initiating VOC oxidation can be used, and that a catalyst bed or other support structure can be used, but it is preferred that the catalyst acts like a perforated plate and insures even air flow therethrough. One suitable monolithic catalyst which has been used in systems of the present invention is available from the Camet Co. of Hiram, Ohio. Thermocouples (not shown) monitor the gas temperature ahead of and subsequent to flow baffles 70, 72 and are connected to a control mechanism (not shown) which adjusts the burner to compensate for any perceived fluctuations in the gas temperature.

The catalyst initiates the incineration (oxidation) of the VOC's, which is an exothermic reaction. The byproducts of this reaction are predominantly $CO_2$ and water vapor, which may be heated to above 700° to 1000° F. or more depending on the particular composition of the VOC's. These hot vapors pass through heat exchange chamber 40 transversely with respect to tubes 50 to transfer the latent heat thereof with the VOC's passing through tubes 50 of the heat exchanger. Thereafter, the exhaust gases, which are substantially devoid of VOC's are discharged to the atmosphere via a discharge conduit 80.

Figure 6:
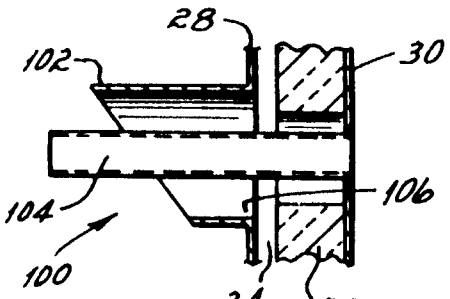
FIG. 6 is a cross-sectional view of the system housing, showing a system access port, taken on line 6—6 of FIG. 1A.

The system of the present invention may preferably include one or more access ports 100, shown specifically in FIG. 6. As shown, outer shell 28 has a penetration guard 102 welded thereto and which protects penetration conduit 104. Conduit 104 passes through an opening 106 in outer shell 28, through insulation 32, and connects to inner shell 30. Temperature, pressure or other parameters within system 10 can be monitored by suitable instruments (not shown) which are inserted via access ports 100. Penetration guard 102 may have an inwardly angled end to prevent rain, etc. from getting into the space 34 between the inner and outer shells.

While the system of the present invention has been described with reference to the specific embodiment shown in the Figures, the scope of the present invention is not intended to be limited to the particular example or configuration shown and described. The scope of the present invention is defined by the appended claims.

What is claimed is:

1. A system for catalytically incinerating volatile organic compounds, comprising:

a dual shell housing having an outer shell and an inner shell, said inner shell capable of expansion and movement relative to said outer shell, and said inner shell defining a heat exchange chamber and a combustion chamber;

a blower for conveying the volatile organics first through said heat exchange chamber and then through said combustion chamber;

a multi-pass, tube-type heat exchanger in said heat exchange chamber, said heat exchanger comprising first and second tube sheets and a plurality of tubes through which the volatile organics pass, affixed at their respective ends to said first and second tube sheets, said heat exchanger suspended within said heat exchange chamber and fixed to said inner shell at one end only so that said heat exchanger can freely expand and contract due to temperature changes within said heat exchange chamber, thereby reducing thermal stresses on said heat exchanger and said housing;

a high pressure blower for supplying combustion air to said combustion chamber and mixing with the volatile organics;

a burner for heating the volatile organics to incineration temperature;

at least one flow baffle disposed within said combustion chamber in the flow path of the heated volatile organics and combustion air to provide a substantially uniform temperature distribution therein; and an oxidation catalyst in said combustion chamber through which the heated volatile organics and combustion air pass, said catalyst initiating incineration of the volatile organics, thereby producing hot exhaust vapors.

2. The system of claim 1, said tubes of said heat exchanger being disposed substantially vertically within said heat exchange chamber.

3. The system of claim 2, said hot exhaust vapors being directed to and flowing through said heat exchange chamber on the shell side of said tubes to preheat the volatile organics flowing through said tubes.

4. The system of claim 1, further comprising:

a flexible joint in the flow path of the volatile organics downstream of said heat exchanger and upstream of said combustion chamber, said flexible joint accommodating expansion of said inner shell.

5. The system of claim 1, further comprising:

a perforated plate in the flow path of the volatile organics downstream of said heat exchanger and upstream of said burner, said perforated plate providing uniform flow of the volatile organics across said burner to reduce localized heating thereof.

6. The system of claim 5, further comprising:

a filter in the flow path of the volatile organics downstream of said heat exchanger and upstream of said perforated plate.

7. The system of claim 1, further comprising:

at least one access port in said housing which penetrates said outer shell and enables the measurement of one or more physical parameters within said system.

* * * * *